US008692643B2

(12) United States Patent
Weber et al.

(10) Patent No.: US 8,692,643 B2
(45) Date of Patent: Apr. 8, 2014

(54) TRANSFORMER WINDING

(71) Applicant: ABB Technology AG, Zürich (CH)

(72) Inventors: Benjamin Weber, Winterberg (DE); Bhavesh Patel, Brilon (DE); Burak Esenlik, Paderborn (DE); Frank Cornelius, Olsberg (DE); Marcos Bockholt, Paderborn (DE); Jens Tepper, Brilon (DE); Karl-Heinz Zillmann, Marsberg (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/934,383

(22) Filed: Jul. 3, 2013

(65) Prior Publication Data

US 2013/0293340 A1 Nov. 7, 2013

Related U.S. Application Data

(63) Continuation of application No. PCT/EP2011/005970, filed on Nov. 29, 2011.

(30) Foreign Application Priority Data

Jan. 5, 2011 (EP) ..... 11000040

(51) Int. Cl.
*H01F 27/30* (2006.01)
*H01F 27/28* (2006.01)

(52) U.S. Cl.
USPC ..... 336/205; 336/198; 336/208; 336/220

(58) Field of Classification Search
USPC ..... 336/220, 198, 208, 205, 182, 180
See application file for complete search history.

(56) References Cited

U.S. PATENT DOCUMENTS

| | | | | |
|---|---|---|---|---|
| 1,840,139 | A * | 1/1932 | Turner | 336/205 |
| 2009/0309685 | A1 * | 12/2009 | Zillmann et al. | 336/170 |
| 2010/0245017 | A1 | 9/2010 | Hoffmann et al. | |

FOREIGN PATENT DOCUMENTS

| | | | |
|---|---|---|---|
| CH | 367562 | A | 2/1963 |
| CN | 201285690 | Y | 8/2009 |
| DE | 287894 | C * | 9/1915 |
| DE | 287894 | C | 10/1915 |
| DE | 102006060567 | A1 | 6/2008 |
| DE | 102007053685 | A1 | 5/2009 |

OTHER PUBLICATIONS

International Search Report (PCT/ISA/210) issued on Apr. 2, 2012, by the European Patent Office as the International Searching Authority for International Application No. PCT/EP2011/005970.

* cited by examiner

*Primary Examiner* — Alexander Talpalatski
*Assistant Examiner* — Mangtin Lian
(74) *Attorney, Agent, or Firm* — Buchanan Ingersoll & Rooney PC

(57) ABSTRACT

An exemplary transformer winding including at least two hollow-cylindrical, axially adjacent winding modules, which are arranged about a common winding axis and have an electrical conductor wound in layers, and a common electrical insulting layer, through which the winding modules are enveloped. The insulating layer has at least one annular, radial depression or annular, radial elevation, which is salient transversely to the winding axis on the radial outer face of said insulating layer.

17 Claims, 3 Drawing Sheets

TRANSFORMER WINDING

RELATED APPLICATION(S)

This application claims priority as a continuation application under 35 U.S.C. §120 to PCT/EP2011/005970, which was filed as an International Application on Nov. 29, 2011 designating the U.S., and which claims priority to European Application 11000040.3 filed in Europe on Jan. 5, 2011. The contents of these prior applications are hereby incorporated by reference in their entireties.

FIELD

The disclosure relates to a transformer winding including at least two axially adjacent winding modules which are arranged hollow-cylindrically around a common winding axis and comprise an electrical conductor wound in layers, and a common electrical insulation layer, by means of which the winding modules are enveloped.

INFORMATION BACKGROUND

Known power transformers, for example, those with a power rating of a few MVA and in a voltage range of, for example, 5 kV to 30 kV or 110 kV, sometimes even up to 170 kV, are also designed as dry-type transformers, wherein, in the last-mentioned voltage range, power ratings of 50 MVA and above are also entirely possible. The high-voltage-side windings can be insulated by a mixture of glass roving and epoxy resin, wherein the insulation layer formed therefrom can surround the winding.

In known design implementations, a winding can be constructed from a plurality of winding modules, e.g., from a plurality of axially adjacent hollow-cylindrical winding segments, which can be galvanically connected to one another radially on the inside and are therefore connected electrically in series. As a result, the voltage stress between radially adjacent winding layers can be reduced, and therefore so is the specified level of insulation complexity. However, this means that there is an increased differential voltage between axially adjacent winding modules at their end faces during operation of the winding, and this increased differential voltage results in increased stress on the insulation layer located therebetween. A corresponding voltage stress can also occur, however, when galvanically isolated windings are arranged axially adjacent to one another. The insulation material as such can be dimensioned readily such that it withstands this voltage stress in its interior.

In the context of the present disclosure, a hollow-cylindrical winding is understood to mean not only a winding with a circular cross section but also the term can include an approximately rectangular cross section with rounded corners. In this way, when installing the winding on a transformer core with a rectangular cross section, optimum use is made of the winding window available.

However, one disadvantage of the known implementations involves the building up of a potential difference along the outer face of the insulation layer of the winding, and in under exemplary conditions over the region of the axially adjacent winding segments. This condition can result in undesired discharges or partial breakdowns along the outer face of the common insulation layer of the winding, which discharges or breakdowns is also promoted by any contamination of the outer face.

SUMMARY

A transformer winding is disclosed comprising: at least two axially adjacent winding modules which are hollow and arranged cylindrically around a common winding axis and include an electrical conductor wound in layers; and a common electrical insulation layer through which the winding modules are enveloped, wherein the insulation layer has, on its radially outer face, at least one ring-like radial depression or ring-like radial elevation which is salient transversely to the winding axis; and wherein the common electrical insulation layer has a wound insulation material and a flexible profiled strip, the flexible profiled strip being arranged transversely to the winding axis and wound in partially through the insulation material, thereby forming at least some of the radial ring-like depressions or elevations.

BRIEF DESCRIPTION OF THE DRAWINGS

The disclosure, further embodiments and further advantages will be described in more detail with reference to the exemplary embodiments illustrated in the drawings, in which.

DETAILED DESCRIPTION

Figure 1:
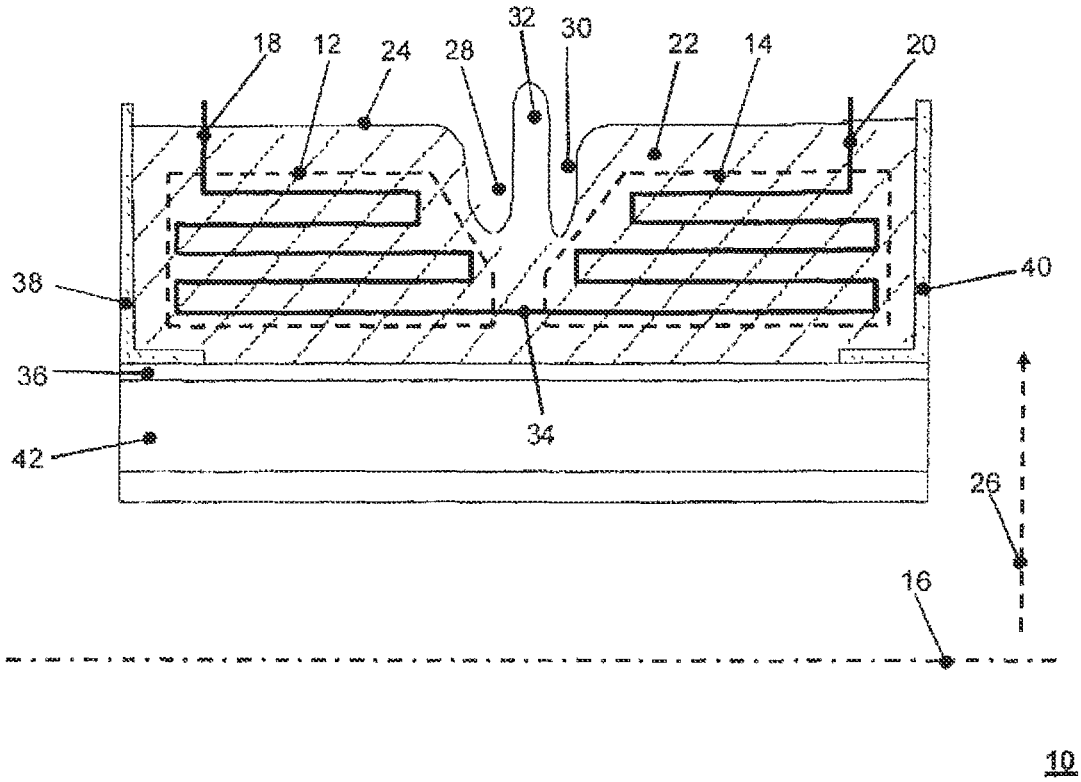
FIG. 1 shows a cross-section through part of a first transformer winding in accordance with an exemplary embodiment of the present disclosure.

Against the background of these known constructions, exemplary embodiments of the present disclosure provide a transformer winding which has improved insulation along the outer face of the insulation layer.

Exemplary embodiments of the present disclosure provide improved insulation through a transformer winding of the type mentioned at the outset. The exemplary insulation layer has, on its radially outer face at least one ring-like radial depression or elevation which is salient (e.g., prominent) transversely to the winding axis.

Such a ring-like radial depression or elevation advantageously extends the leakage path along an axial extent of the surface, wherein the voltage stress likewise takes effect along the axial surface owing to the axially adjacent arrangement of the winding modules. Therefore, in a similar way to as in the case of ribs on a ceramic insulator, the voltage loading capacity can be increased, while an increase in the physical size, at least in the case of depressions, is advantageously avoided. The configuration of a depression or an elevation can have, for example, a rectangular, semi-circular, parabolic, shield-like or else Gaussian curve-like cross section. Ultimately an extension of the leakage path along the surface and the avoidance of the formation of a continuous film of moisture on the surface should be achieved.

Corresponding to an exemplary configuration of the transformer winding according to the disclosure, the at least one ring-like radial depression or elevation completely surrounds the transformer winding, e.g., at an angle of 360° around the winding axis. Therefore, advantageously there is an extension of the axial leakage path uniformly over the complete winding circumference. In addition, the manufacture of the insulation layer which is usually likewise wound is thus correspondingly simplified. However, even subsequent milling of a ring-like radial depression into an existing insulation layer, for example, is thus also simplified.

In accordance with an exemplary embodiment of the disclosure, at least one ring-like radial depression is arranged between the at least two axially adjacent winding modules. As already discussed, the greatest differential voltage or field strength is to be expected at the depression for which reason an extension of the leakage path has an advantageous effect there on the insulation capacity of the winding. In addition, such a depression can be designed to be deeper there than directly above a winding module because the depression can protrude into the space between the axially adjacent winding modules. In this way, the leakage path in the most critical region in terms of insulation is extended in an effective manner.

An exemplary depression arranged in such a way can be realized effectively according to the disclosure if a radially outer winding layer of a winding module is shortened axially in comparison with winding layers positioned radially beneath this outer winding layer. Then, the space existing between the axially adjacent winding modules is enlarged in the radially outer region, for which reason an enlarged space for the arrangement of a radial ring-like depression is also available there. The dielectric strength is thus advantageously increased given a corresponding configuration of the depression.

The transformer winding can be manufactured according to an exemplary embodiment of the disclosure if it is arranged on a coil former. It has proven to be likewise advantageous in terms of manufacturing if the winding is delimited at both of its axial end faces by a respective end plate. Then, a type of laterally delimited coil former is formed, which can be suitable for a winding operation in which both the electrical conductor and the insulation layer are wound in a common manufacturing process.

Corresponding to an exemplary embodiment of the present disclosure, said winding has at least two winding modules which are galvanically connected to one another radially on the inside. By splitting a high-voltage winding into a plurality of winding modules, the voltage stress between adjacent winding layers is advantageously reduced, which reduces the insulation complexity between the layers in an advantageous manner. When using four winding modules connected in series, the two axially outer winding modules could then be galvanically connected to the two axially inner winding modules radially on the inside and the two inner winding modules radially on the outside an exemplary embodiment of the present disclosure. According to the present disclosure, however, provision is also made for the winding to include at least two groups of in each case two winding modules which are galvanically connected to one another radially on the inside, which are not in all arrangements galvanically connected to one another.

Corresponding to an exemplary configuration of the winding disclosed herein, the common electrical insulation layer has a wound insulation material, for example a fiber roving. This material can be wound during manufacture together with the electrical conductor, wherein the fiber roving has been impregnated with a moist epoxy resin, for example. After such a winding operation, the winding then should be heated to a polymerization temperature, for example 160° C. depending on the resin used, for curing the resin, with the result that the resin then completely cures.

However, the use of a dry or at least adhesive, strip-like insulation material has proven to be advantageous for the winding of depressions or elevations according to the disclosure because such an insulation material is markedly more dimensionally stable during the winding operation. Thus, the winding of an elevation with a rectangular cross section, for example, is possible in a simple manner owing to a correspondingly large number of winding layers of a dry insulation strip being wound one above the other.

The dielectric strength of a dry-wound insulation strip or fiber roving is usually reduced, however, owing to the infinitesimally small gaps produced between the layers, for example, since a correspondingly high degree of mechanical stability is also difficult to ensure, possibly by the use of an adhesive layer on a flat side of the insulation strip. According to an exemplary embodiment of the present disclosure, therefore, provision is also made for the wound insulation material to be a fiber roving or else glass fiber roving which has been preimpregnated with B-stage resin, which roving has been heated to a polymerization temperature after the winding operation.

In the context of the present disclosure, B stage resin means that the curing process for the resin has already begun but was then intentionally interrupted such that the resin is in a state of incomplete polymerization. In another exemplary embodiment B stage resin can, however, also mean that this resin has made the transition to a solid state as a result of corresponding heating to a melting point of 80° C., for example, with subsequent cooling, without the actual chemical reaction of the polymerization having been initiated. In such a state, the resin can melt again at a corresponding temperature, wherein the actual polymerization takes place at a temperature above the melting point, for example at a baking temperature in the range of from 120° C. to 140° C.

Owing to the use of such a resin, such as an epoxy resin, both a dimensionally stable winding operation is enabled and a high dielectric strength and mechanical stability is enabled owing to the subsequent melting and polymerization process.

In another exemplary configuration of the transformer winding according to the present disclosure, the common electrical insulation layer has a flexible profiled strip, which is arranged transversely to the winding axis and can be partially wound in by means of the insulation material and by means of which at least some of the radial ring-like depressions or elevations are formed. The profiled strip is manufactured from an insulation material and protrudes, in an exemplary direction, with a first part out of the radial outer face of the insulation layer and is arranged with a second part in the insulation layer and is fixed by virtue of the fact that profile regions running parallel to the winding axis can be fixed with wound insulation material. Ultimately, the profiled strip can be considered to be part of the insulation layer itself, however, by means of which the leakage path is advantageously extended.

In accordance with yet another exemplary embodiment of the transformer winding, the flexible profiled strip can have a T-shaped profile cross section. This arrangement can be suitable for anchoring in the insulation layer. However, other profile forms such as a multiple T cross section, for example a TTT cross section, can also be conceivable, which, if specified, should then also be arranged so deeply in the insulation that it does not protrude but a depression is formed thereby.

In accordance with an exemplary embodiment of the disclosure, the flexible profiled strip is formed at least predominantly of a silicone rubber. Owing to the high degree of material flexibility, this can be easily matched to the outer contour form of the one winding according to the disclosure, but pre-bent and possibly less flexible profiled strip sections could also be used, of course.

The advantages according to the disclosure of an improved insulation capacity of a winding are also demonstrated for a transformer which has a transformer core and at least one, and in another exemplary embodiment three, windings according to the disclosure. These windings can be specified for implementing a three-phase transformer, as is in known power distribution systems.

FIG. 1 shows a cross-section through part of a first transformer winding in accordance with an exemplary embodiment of the present disclosure. FIG. 1 shows a section through part of a first exemplary transformer winding 10, which is arranged rotationally and symmetrically around a winding axis 16. The winding is arranged on a coil former 36, which is delimited at its axial ends by two end plates 38, 40. Two axial adjacent hollow-cylindrical winding modules 12, 14 are provided, which each include a plurality of winding layers of an individual conductor 18, 20. A winding layer is illustrated as a horizontal line in the drawing, but this symbolizes a multiplicity of axially adjacent turns of a conductor 18, 20, which for its part is arranged around the winding axis 16. The two winding modules 12, 14 are connected electrically to one another in series by means of a galvanic connection 34. By splitting the winding into two winding modules 12, 14, the voltage stress between the individual winding layers is advantageously halved.

Both winding modules 12, 14 can be surrounded by a common insulation layer 22, in this case a wound insulation material which has been preimpregnated with an epoxy resin in the B stage, which has finally been heated to a polymerization temperature. The insulation layer 22 not only surrounds the outer faces of the winding, but it is also provided between these outer faces between the individual winding layers as well and therefore ensures electrical insulation between the wound conductor layers.

During operation of the winding 10, the greatest voltage stress is produced at the radial outer face 24 of the insulation layer precisely between the two winding modules 12, 14. In order to avoid a discharge or partial breakdown along the outer face, two ring-like radial 26 depressions 28, 30 and an elevation 32 therebetween are provided, which are used to extend the leakage path along the axial extent of the outer face 24.

Provided radially on the inside is a further winding 42, which is intended to symbolize a low-voltage-side winding, whereas the radially outer winding according to the disclosure is intended to symbolize a high-voltage-side winding with a rated voltage of 60 kV, for example. In the case of a low-voltage-side winding, an extension of the leakage path in accordance with the disclosure as a result of the lower voltage stress associated with a lower rated voltage of 6 kV, for example, is not specified.

Figure 2:
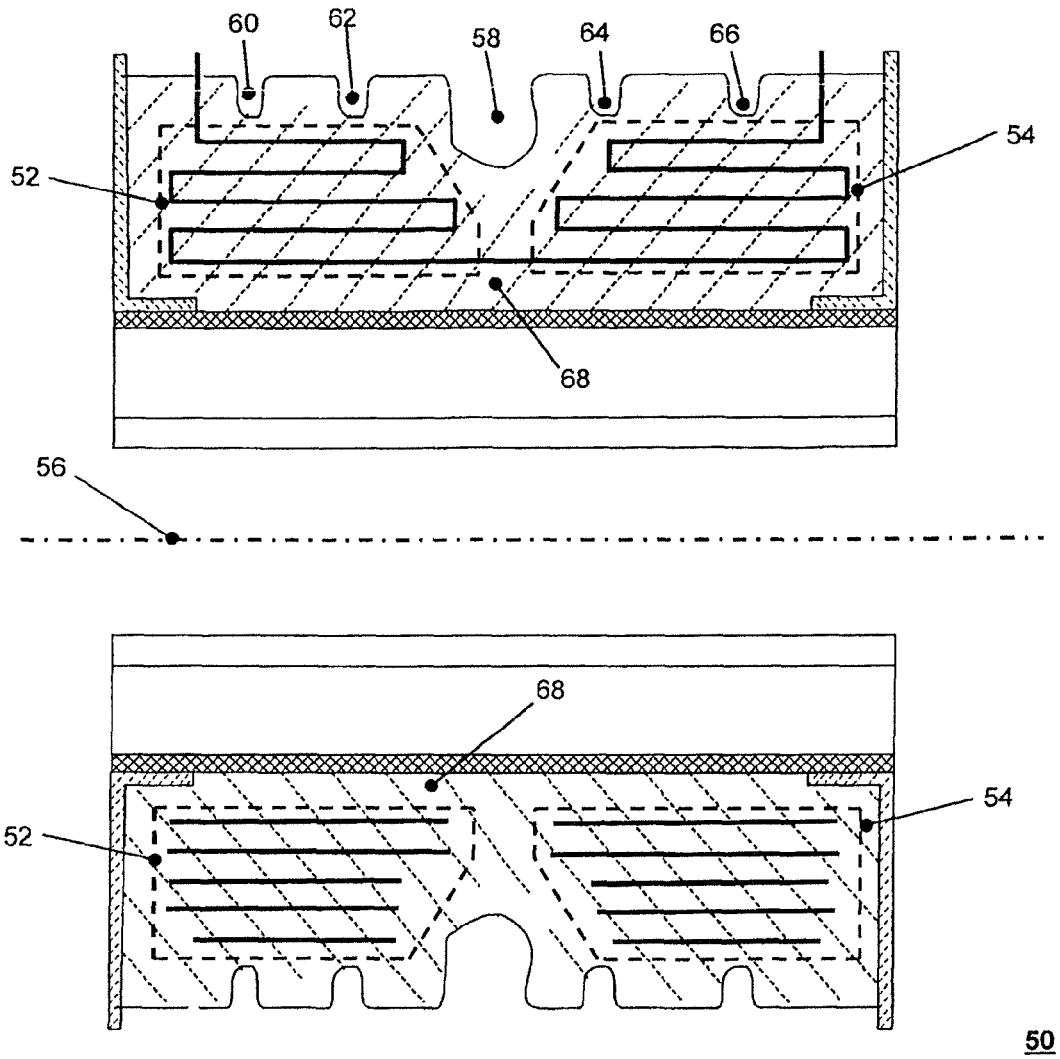
FIG. 2 shows a cross-section through a second transformer winding in accordance with an exemplary embodiment of the present disclosure.

FIG. 2 shows a cross-section through a second transformer winding in accordance with an exemplary embodiment of the present disclosure. FIG. 2 shows a complete section through a second exemplary transformer winding 50, e.g., with a partial section above the winding axis 56 and with a partial section below the winding axis 56. Two hollow-cylindrical and axially adjacent winding modules 52, 54, which are each indicated by five winding layers, are arranged around the winding axis 56. In the upper section, the galvanic connections between the layers and the galvanic connection between the winding modules 52, 54 are illustrated, while in the lower section only the winding layers are illustrated. The two winding modules are surrounded by a common insulation layer 68. Five ring-like radial depressions 58, 60, 62, 64, 66 are arranged on the radial outer face of the insulation layer 68 and serve to extend the leakage path. Depending on the boundary conditions in respect of design, depressions have proven to be more advantageous than elevations because they do not have any additional specifications in terms of space and also enable a material saving. The respective radially outer two winding layers are set back axially in the axial center of the winding 50, with the result that the ring-like radial depression 58 could be correspondingly deeper and larger than the other depressions 60, 62, 64, 66. This arrangement has proven to be advantageous because the greatest voltage stress is also to be expected operationally in the axial interspace between the two winding modules along the outer face of the insulation layer. Therefore, the extension of the leakage path advantageously correlates to the local voltage stress.

Figure 3:
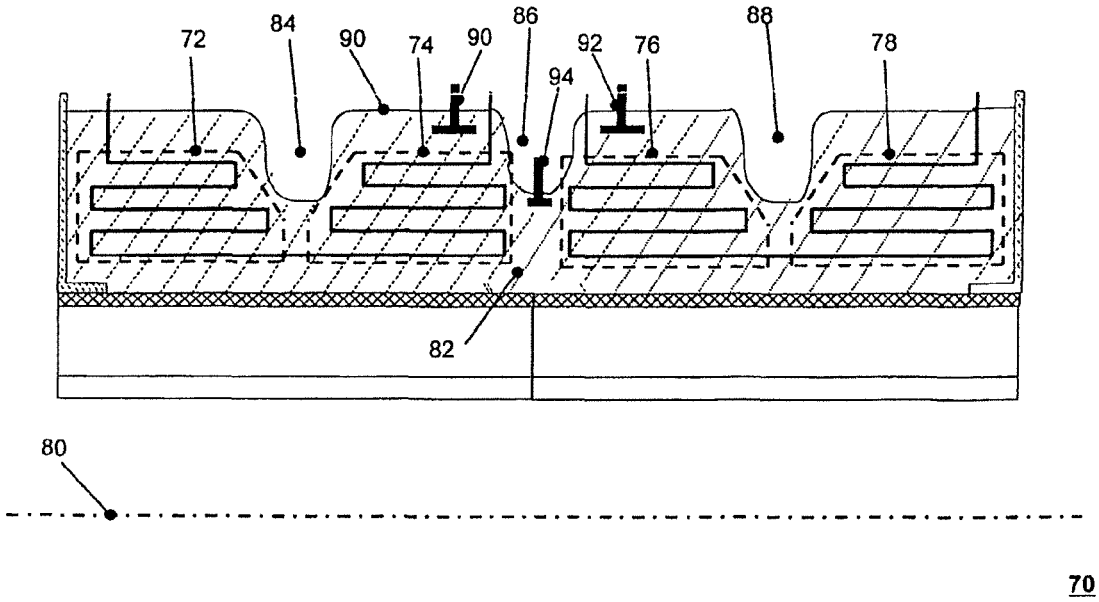
FIG. 3 shows a cross-section through part of a third transformer winding in accordance with an exemplary embodiment of the present disclosure.

FIG. 3 shows a cross-section through part of a third transformer winding in accordance with an exemplary embodiment of the present disclosure. As shown in FIG. 3, the transformer winding 70 is arranged around a winding axis 80. The winding substantially corresponds to the winding 10 shown in FIG. 1, but four axially adjacent winding modules 72, 74, 76, 78 are provided in contrast to this, which winding modules are divided into in each case two subgroups which are galvanically connected to one another, said subgroups including the winding modules 72 and 74 and 76 and 78, wherein the groups are galvanically isolated from one another. The winding modules 72, 74, 76, 78 are surrounded by a common insulation layer 82 or enclosed therein. The greatest voltage stresses along the radial outer face 90 can occur in the axial direction between adjacent winding modules 72, 74, 76, 78. These are also precisely the regions at which the leakage path has been extended in the axial direction by corresponding radial ring-like depressions 84, 86, 88, with the result that a correspondingly increased dielectric strength results.

A further leakage path extension in the region of the adjoining subgroups 72, 74 and 76, 78 can be realized by flexible profiled strips 90, 92, 94 protruding out of the insulation material, wherein the profiled strip arranged in the depression 86 only protrudes out of the base of the depression, but not out of the winding surface. The profiled strips are manufactured from an electrically insulating material, such as a silicone rubber, for example. In their lower region, e.g., radially inner region, the T-shaped profiled strips are fixed by a plurality of layers of a wound insulation material which surround the transversely extending T bar. Owing to the part producing out of the radial surface of the insulation layer, the leakage path is then extended.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Section through part of a first exemplary transformer winding
12 First winding module of first transformer winding
14 Second winding module of first transformer winding
16 Winding axis
18 Conductor of first winding module
20 Conductor of second winding module
22 First common electrical insulation layer
24 Radial outer face of first insulation layer
26 Radial alignment
28 First depression running transversely to the winding axis
30 Second depression running transversely to the winding axis
32 First elevation running transverse to the winding axis

34 Galvanic connection
36 Coil former
38 First end plate
40 Second end plate
42 Further transformer winding
50 Section through second exemplary transformer winding
52 First winding module of second transformer winding
54 Second winding module of second transformer winding
56 Winding axis
58 First depression running transversely to the winding axis
60 Second depression running transversely to the winding axis
62 Third depression running transversely to the winding axis
64 Fourth depression running transversely to the winding axis
66 Fifth depression running transversely to the winding axis
68 Second common electrical insulation layer
70 Section through part of a third exemplary transformer winding
72 First winding module of third transformer winding
74 Second winding module of third transformer winding
76 Third winding module of third transformer winding
78 Fourth winding module of third transformer winding
80 Winding axis
82 Third common electrical insulation layer
84 First depression running transversely to the winding axis
86 Second depression running transversely to the winding axis
88 Third depression running transversely to the winding axis
90 Radial outer face of third insulation layer
92 First flexible profiled strip
94 Second flexible profiled strip
96 Third flexible profiled strip

What is claimed is:

1. A transformer winding comprising:

at least two axially adjacent winding modules which are hollow and arranged cylindrically around a common winding axis and include an electrical conductor wound in layers; and a common electrical insulation layer through which the winding modules are enveloped, wherein the insulation layer has, on a radially outer face, at least one ring-like radial depression or ring-like radial elevation which is salient transversely to the winding axis; and wherein the common electrical insulation layer has a wound insulation material and a flexible profiled strip, the flexible profiled strip being arranged transversely to the winding axis and wound in partially through the insulation material, thereby forming at least some of the radial ring-like depressions or elevations wherein at least one ring-like radial depression is arranged between the at least two axially adjacent winding modules; and wherein a radially outer winding layer of a winding module is shortened axially in comparison with winding layers positioned radially beneath the outer winding layer and a form of the ring-like radial depression is matched to the radially outer winding layer.

2. The transformer winding as claimed in claim 1, wherein the at least one ring-like radial depression or elevation completely surrounds the transformer winding.

3. The transformer winding as claimed in claim 1, wherein said transformer winding is arranged on a coil former.

4. The transformer winding as claimed in claim 1, wherein said transformer winding is delimited at both of its axial end faces by a respective end plate.

5. The transformer winding as claimed in claim 1, wherein at least two winding modules are galvanically connected to one another radially on the inside.

6. The transformer winding as claimed in claim 5, wherein said transformer winding includes at least two groups of in each case two winding modules which are galvanically connected to one another radially on the inside.

7. The transformer winding as claimed in claim 2, wherein said transformer winding is arranged on a coil former.

8. The transformer winding as claimed in claim 2, wherein said transformer winding is delimited at both of its axial end faces by a respective end plate.

9. The transformer winding as claimed in claim 2, wherein at least two winding modules are galvanically connected to one another radially on the inside.

10. The transformer winding as claimed in claim 1, wherein said transformer winding is arranged on a coil former.

11. The transformer winding as claimed in claim 1, wherein said transformer winding is delimited at both of its axial end faces by a respective end plate.

12. The transformer winding as claimed in claim 1, wherein at least two winding modules are galvanically connected to one another radially on the inside.

13. The transformer winding as claimed in claim 1, wherein the wound insulation material is a dry insulation material.

14. The transformer winding as claimed in claim 13, wherein the wound insulation material is a fiber roving which has been preimpregnated with B-stage resin and which has been heated to a polymerization temperature after the winding operation.

15. The transformer winding as claimed in claim 1, wherein the flexible profiled strip has a T-shaped profile.

16. The transformer winding as claimed in claim 1, wherein the flexible profiled strip is formed substantially of a silicone rubber.

17. A transformer comprising:

a transformer core and at least one low-voltage-side and one high-voltage-side transformer winding, wherein the high-voltage-side transformer winding is designed as claimed in claim 1.

* * * * *